US006109086A

United States Patent [19]

Gambrel et al.

[11] Patent Number: 6,109,086

[45] Date of Patent: Aug. 29, 2000

[54] PUNCH AND METHOD FOR FORMING SLUGLESS PIERCED CONICAL EXTRUSIONS

[75] Inventors: Steven W. Gambrel, Clarkston; Lawrence P. Bourgeois, Clinton Township, both of Mich.

[73] Assignee: DaimlerChrysler Corporation, Auburn Hill, Mich.

[21] Appl. No.: 09/339,448

[22] Filed: Jun. 24, 1999

[51] Int. Cl.[7] ..... B21D 28/10

[52] U.S. Cl. ..... 72/326; 72/325

[58] Field of Search ..... 72/325, 324, 479, 72/326; 29/896.6

[56] References Cited

U.S. PATENT DOCUMENTS

| | | | |
|---|---|---|---|
| 518,766 | 4/1894 | Plecker . | |
| 1,468,271 | 9/1923 | Bechtel | 72/325 |
| 2,135,417 | 11/1938 | Tinnerman | 29/148 |
| 2,169,056 | 8/1939 | Place | 29/148 |
| 2,180,545 | 11/1939 | Parsons et al. | 153/2 |
| 2,928,450 | 3/1960 | Belding | 153/21 |
| 3,353,436 | 11/1967 | Jaworski | 85/32 |
| 3,685,336 | 8/1972 | Black, Jr. | 72/325 |
| 4,404,835 | 9/1983 | Frith | 72/325 |
| 4,509,355 | 4/1985 | Oishi | 72/325 |
| 4,540,011 | 9/1985 | Croxford et al. | 137/15 |

FOREIGN PATENT DOCUMENTS

| | | | |
|---|---|---|---|
| 117836 | 9/1981 | Japan | 72/325 |
| 96328 | 5/1985 | Japan | 72/325 |

*Primary Examiner*—Daniel C. Crane
*Attorney, Agent, or Firm*—Lawrence J. Shurupoff

[57] ABSTRACT

A punch for forming a slugless, pierced conical extrusion in a sheet metal panel. The punch has a cylindrical shank with a hole-forming portion at one end. The hole-forming portion includes a cylindrical extruding portion axially outwardly of the end of the shank and a cylindrical piercing tip axially outwardly of the extruding portion. The piercing tip has an outer end formed with a flat radial surface perpendicular to the central axis of the punch and a flat ramped surface extending at an acute angle to the radial surface. The acute angle is in a range from 40° to 50° preferably 45°. Upon initial axially outward advance of the punch, the piercing tip punches a hole in the sheet metal panel leaving punched-out material attached at an edge of the hole. Upon further axially outward advance of the punch, the extruding portion forms a conical extrusion around the hole. The hole is pierced, coned and extruded in one continuous stroke of the punch.

12 Claims, 2 Drawing Sheets

PUNCH AND METHOD FOR FORMING SLUGLESS PIERCED CONICAL EXTRUSIONS

This invention relates generally to forming holes in sheet material and more particularly to a punch and method for forming a slugless pierced conical extrusion in the sheet material.

BACKGROUND OF THE INVENTION

Typically when a hole is punched in sheet material, a slug of punched-out material becomes separated from the sheet. The slugs have no use whatsoever and are nothing but scrap. The slugs must be collected and either recycled or disposed of in some manner; otherwise they become a hazard to personnel and surrounding machinery. When the punching process is upward through the sheet material, the slugs often bounce around on top of the sheet material and are even more difficult to deal with.

SUMMARY OF THE INVENTION

In accordance with the present invention, the punched-out material remains attached to the sheet material. There is no separated slug of material and hence the process may be considered "slugless." The problem of dealing with scrap material is avoided. There are no slugs to jam machinery and damage dies.

Further in accordance with the invention, a punch is provided having a hole-forming portion including a piercing tip formed with an outer end having a flat radial surface and a flat ramped surface at an acute angle to the radial surface. Preferably the acute angle is in a range of 40° to 50°, and ideally is 45°.

The hole-forming portion of the punch also includes an extruding portion between the shank and the piercing tip. Upon initial advance of the shank, the piercing tip punches a hole in the sheet material and leaves the punched-out material attached to an edge of the hole. Upon further advance of the shank, the extruding portion forms a conical extrusion around the hole.

The punch of this invention, in one continuous stroke, pierces a hole in the sheet material and then cones and extrudes the sheet material around the pierced hole. The punched-out material remains attached and is not a problem.

The slugless pierced conical extrusion is adapted to receive a thread-forming screw which has many useful applications, including attaching components such as voltage regulators, ignition coils, door and window latches, deck lid hinges, radio regulators and fuel and brake line clips. Sheet material having slugless pierced conical extrusions with thread-forming screws are especially useful in circumstances in which they are subjected to shear rather than high tensile loads.

One object of this invention is to provide a punch and a method for forming slugless pierced conical extrusions in sheet material having the foregoing features and capabilities.

Another object is to provide a punch which is rugged and durable in use, and is capable of piercing, coning and extruding the sheet material around the pierced hole without causing a slug of punched-out material to be separated from the sheet material.

These and other objects, features and advantages will become more apparent as the following description proceeds, especially when considered with the accompanying drawings.

DETAILED DESCRIPTION OF THE PREFERRED EMBODIMENT

Figure 1:
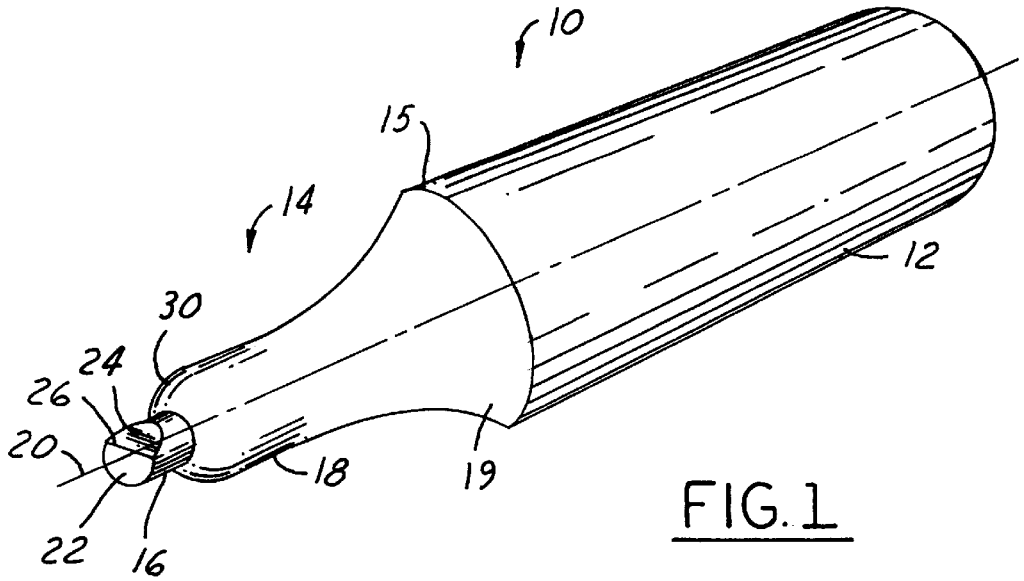
FIG. 1 is a perspective view of a punch constructed in accordance with the invention.
Figure 2:
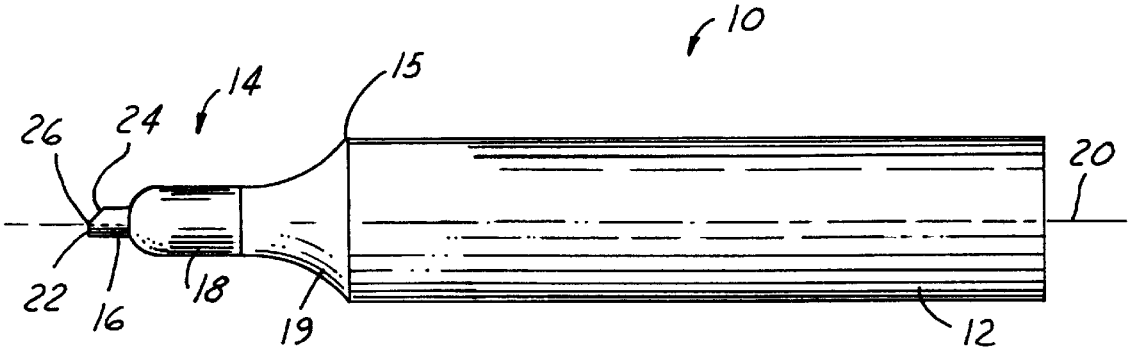
FIG. 2 is a side elevational view of the punch.
Figure 3:
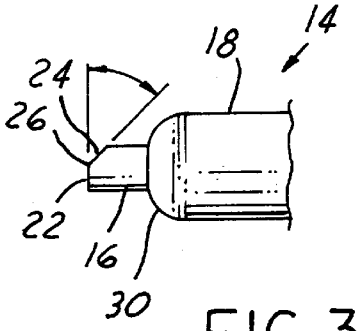
FIG. 3 is a somewhat enlarged fragmentary side elevational view of a portion of the hole-forming end portion of the punch.
Figure 8:
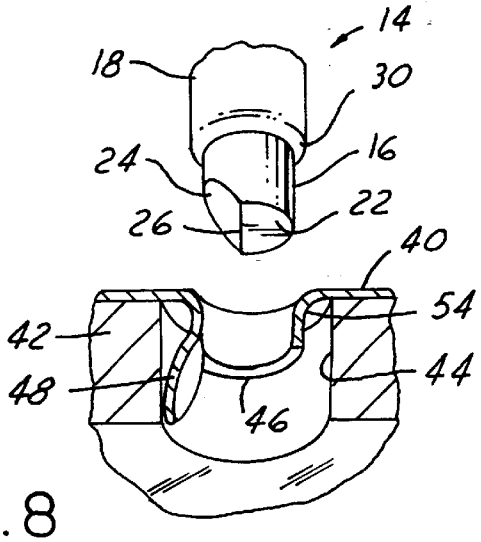
FIG. 8 is a fragmentary perspective view of the sheet material and punch after the punch has been withdrawn from the sheet material following formation of the slugless pierced conical extrusion.

Referring now more particularly to the drawings, a punch 10 is shown, having an elongated cylindrical shank 12, and a hole-forming portion 14 at the outer end 15 thereof. The hole-forming portion 14 includes a piercing tip 16 and an extruding portion 18.

The extruding portion 18 extends axially outwardly from the outer end 15 of the shank. The extruding portion 18 is cylindrical, that is, it has a cylindrical side wall, and is connected to the outer end of the shank by an intermediate section 19 of gradually decreasing diameter from the end 15 of the shank to the extruding portion.

The piercing tip 16 is cylindrical, that is, it has a cylindrical side wall, and extends axially outwardly from the outer end of the extruding portion 18. The piercing tip 16 is axially aligned with and of smaller diameter than the extruding portion.

The shank 12, extruding portion 18 and piercing tip 16 have a common longitudinally extending central axis 20.

The piercing tip 16 has an outer end formed with a flat radial surface 22 perpendicular to the central axis 20 of the punch, and a flat ramped surface 24. The ramped surface 24 intersects the radial surface 22 along a straight line 26 and is slanted from the line 26 in an axially inward direction toward the shank 12 at an acute angle to the radial surface 22. The acute angle is within the range of 40°–50°, and preferably 45°.

The extruding portion 18 has a convex, annular, circular outer end wall 30 which extends radially outwardly from the piercing tip 16 in an arcuate curve and blends smoothly into the cylindrical side wall of the extruding portion 18.

The punch 10 is adapted to form a slugless, pierced, conical extrusion in sheet material 40 shown as a metal panel or sheet.

Figure 4:
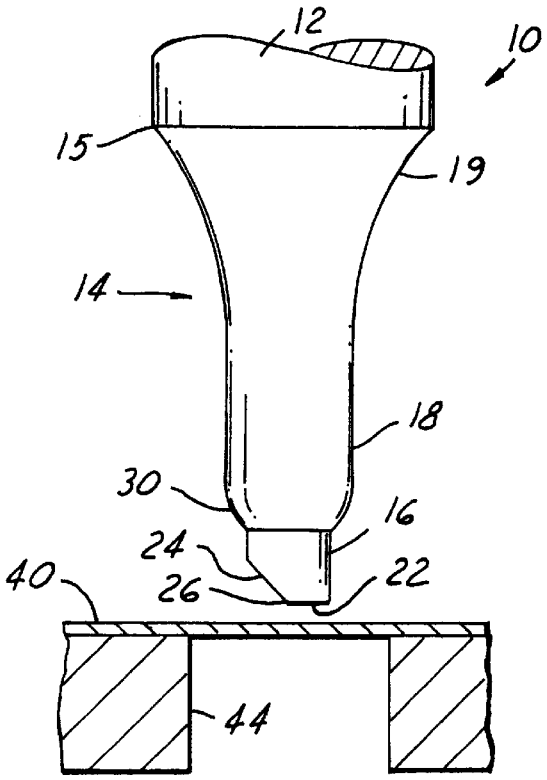
FIG. 4 is an elevational view showing the hole-forming end portion of the punch prior to engagement with the sheet material.
Figure 5:
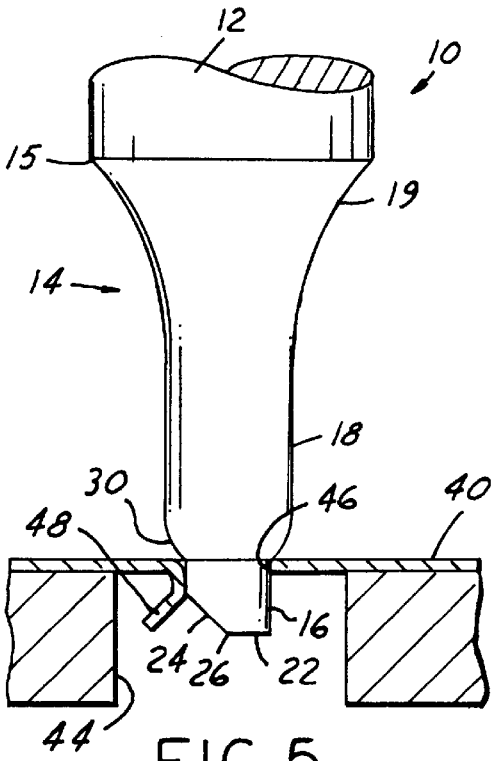
FIG. 5. is a view similar to FIG. 4 but shows the punch after an initial advance in which the piercing tip has punched a hole in the sheet material.

The punch is advanced in an axially outward direction from a retracted position, as shown in FIGS. 4–7. FIG. 4 shows the punch in the retracted position opposite the sheet material 40 which rests on a support 42 over an opening 44 in the support. The punch is aligned with the opening 44 and is initially axially outwardly advanced to the position shown in FIG. 5 in which the piercing tip 16 has pierced the sheet material, forming a hole 46 with punched-out material 48 attached to the sheet material at an edge of the hole.

Figure 6:
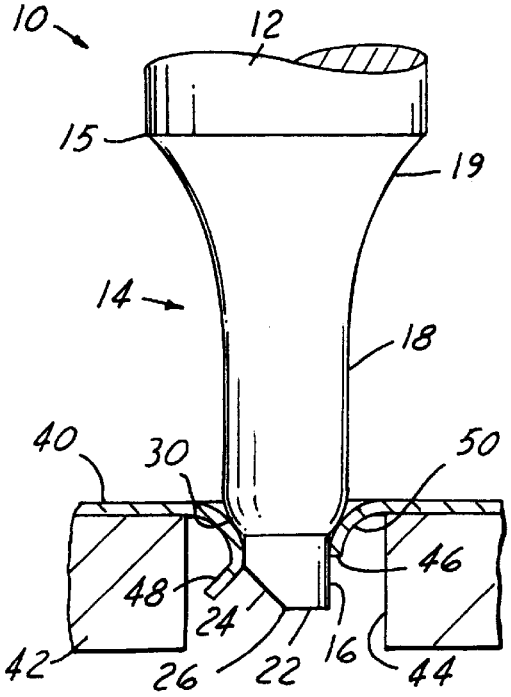
FIG. 6 is a view similar to FIGS. 4 and 5 after further advance of the punch and partial coning and extrusion of the sheet material.

The punch 10 is further axially outwardly advanced to the FIG. 6 position in which the convex outer end wall 30 of the extruding portion 18 partially cones and extrudes the portion 50 of the sheet 40 surrounding the hole 46.

Figure 7:
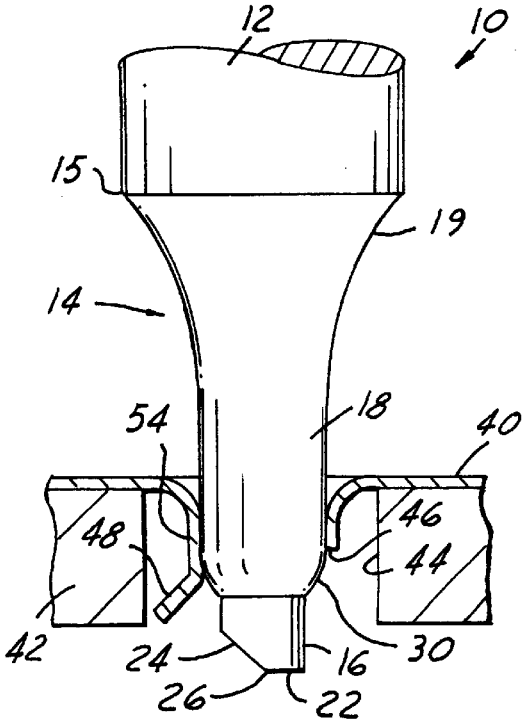
FIG. 7 is a view similar to FIGS. 4–6 after still further advance of the punch and full coning and extrusion of the sheet material around the hole.

The punch is still further axially outwardly advanced to the FIG. 7 position in which the side wall of the extruding position 18 further cones and extrudes the portion of the sheet 40 surrounding the hole, forming a slugless, pierced, conical extrusion 54.

The punch is moved in one continuous stroke from the FIG. 4 position to the FIG. 7 position, and then withdrawn to the FIG. 4 position. The punched-out material 48 remains attached to the sheet material at the edge of the hole 46 and never needs to be removed. A thread-forming screw, not shown, may be engaged in the pierced conical extrusion 54, forming a thread therein as it enters, and be used to attach any desired component to the sheet material.

What is claimed is:

1. A punch for forming a slugless hole in sheet material and forming a conical extrusion around the hole comprising:

an elongated cylindrical shank having a hole-forming portion at one end thereof, said hole-forming portion including an extruding portion axially outwardly of the end of said shank and a cylindrical piercing tip, of smaller diameter than said extruding portion, axially outwardly of said extruding portion, said shank, extruding portion and piercing tip having a common longitudinal central axis, said piercing tip having an outer end formed with a flat radial surface perpendicular to said central axis and a flat ramped surface extending at an acute angle to said radial surface, said piercing tip being adapted, upon initial axially outward advance of said shank, to punch a hole in the sheet material leaving punched-out material attached to an edge of the hole, said extruding portion being adapted, upon further axially outward advance of said shank, to form in the sheet material a conical extrusion around the hole.

2. A punch according to claim 1 wherein said extruding portion has a cylindrical side wall and a convex annular, circular outer end wall, said annular outer end wall extending radially outwardly from said piercing tip in an arcuate curve and blending smoothly into said cylindrical side wall.

3. A punch according to claim 2 wherein said ramped surface intersects said radial surface along a straight line and is slanted from said straight line in an axially inward direction toward the shank at said acute angle.

4. A punch according to claim 3, wherein the acute angle is in a range from 40° to 50°.

5. A punch according to claim 3, wherein the acute angle is 45°.

6. A method of forming a slugless hole in sheet material and forming a conical extrusion around the hole comprising:

providing a punch comprising an elongated shank having a hole-forming portion at one end thereof, the hole-forming portion including an extruding portion extending axially outwardly from the end of the shank and a cylindrical piercing tip, of smaller diameter than said extruding portion, extending axially outwardly from said extruding portion, the shank, extruding portion and piercing tip having a common longitudinal axis, and the piercing tip having an outer end formed with a flat radial surface perpendicular to the central axis and a flat ramped surface extending at an acute angle to the radial surface, advancing the shank axially outwardly an initial distance toward and through the sheet material to cause the piercing tip to punch a hole therein leaving punched-out material attached to an edge of the hole, and advancing the shank axially outwardly a further distance to cause the extruding portion to form a conical extrusion around the hole, the advancing of said shank said initial distance and said further distance occurring in one continuous stroke.

7. A method according to claim 6, wherein said ramped surface intersects said radial surface along a straight line and is slanted from said straight line in an axially inward direction toward said shank at said acute angle, said acute angle being in a range of 40° to 50°.

8. A method according to claim 7, wherein said acute angle is 45°.

9. A punch for forming a slugless hole in sheet material and forming a conical extrusion around the hole comprising:

an elongated shank having a hole-forming portion at one end thereof, said hole-forming portion including an extruding portion axially outwardly of the end of said shank and a piercing tip, of smaller cross-section than said extruding portion, axially outwardly of said extruding portion, said piercing tip having a generally radial outer end surface and a ramped surface extending at an acute angle to said generally radial outer end surface, said piercing tip being adapted, upon initial axially outward advance of said shank, to punch a hole in the sheet material leaving punched-out material attached to an edge of the hole, said extruding portion being adapted, upon further axially outward advance of said shank, to form in the sheet material a conical extrusion around the hole.

10. A punch according to claim 9, wherein the acute angle is in a range from 40° to 50°.

11. A method of forming a slugless hole in sheet material and forming a conical extrusion around the hole comprising:

providing a punch comprising an elongated shank having a hole-forming portion at one end thereof, the hole-forming portion including an extruding portion extending axially outwardly from the end of the shank and a piercing tip, of smaller cross-section than said extruding portion, extending axially outwardly from said extruding portion, the piercing tip having a generally radial outer end surface and a ramped surface extending at an acute angle to the generally radial outer end surface, advancing the shank axially outwardly an initial distance toward and through the sheet material to cause the piercing tip to punch a hole therein leaving punched-out material attached to an edge of the hole, and advancing the shank axially outwardly a further distance to cause the extruding portion to form a conical extrusion around the hole.

12. A method according to claim 11, wherein said acute angle is in a range of 40° to 50°.

* * * * *